United States Patent [19]

Castle

[11] Patent Number: 4,844,403

[45] Date of Patent: Jul. 4, 1989

[54] REUSABLE FORM FOR STORM SEWER COLLECTION BOX INLETS

[75] Inventor: Homer Castle, Kansas City, Kans.

[73] Assignee: Carl Orser, Merriam, Kans.

[21] Appl. No.: 188,901

[22] Filed: May 2, 1988

[51] Int. Cl.[4] ..... E02D 29/14; B28B 7/18

[52] U.S. Cl. ..... 249/10; 249/90; 249/145; 249/163; 249/188; 249/219.1

[58] Field of Search ..... 249/1, 2, 8, 10, 11, 249/83, 90, 144, 145, 188, 207, 208, 219.1, 163

[56] References Cited

U.S. PATENT DOCUMENTS

| | | | |
|---|---|---|---|
| 297,995 | 5/1984 | Hewitt | 249/163 |
| 729,852 | 6/1903 | Estell | 249/8 |
| 859,530 | 7/1907 | Stempel | 249/156 |
| 2,610,381 | 9/1952 | Rosati et al. | 249/2 |
| 2,630,614 | 3/1953 | Peterson | 249/13 |
| 2,726,866 | 12/1955 | Nally | 272/3 |
| 2,817,137 | 12/1957 | Mitchell | 249/2 |
| 2,908,063 | 10/1959 | Jones et al. | 249/13 |
| 3,123,884 | 3/1964 | Miller | 249/10 |
| 3,436,051 | 4/1969 | Nakahara | 249/1 |
| 3,831,897 | 8/1974 | Stegmeier | 249/1 |
| 4,219,513 | 8/1980 | Miller | 264/32 |
| 4,318,880 | 3/1982 | McIntosh et al. | 264/267 |
| 4,406,439 | 9/1983 | Gorter | 249/64 |
| 4,637,585 | 1/1987 | Picollo | 249/145 |

*Primary Examiner*—James Housel

*Attorney, Agent, or Firm*—Litman, McMahon & Brown

[57] ABSTRACT

A cover for a storm drain collection box is formed using falsework that includes a portion that is prefabricated and another portion that is constructed in-situ. The prefabricated portion of the falsework is used to form the throat section of the collection box inlet and can be mass produced under quality- and research-controlled conditions. The in-situ constructed portions of the falsework permit it to be modified according to the needs of the particular collection box. Alternatively, both the cover and the collection box can be precast for in-situ assembly.

17 Claims, 2 Drawing Sheets

REUSABLE FORM FOR STORM SEWER COLLECTION BOX INLETS

BACKGROUND OF THE INVENTION

1. Field of the Invention.

The present invention relates, in general, to the construction of sewage systems, and in particular, to the construction of storm drains. Specifically, the invention relates to the construction of a cover for a storm drain collection box.

2. Description of the Prior Art.

A sewage system is any of several drainage systems for carrying surface water and/or sewage for disposal. Each of the several drainage systems is generally subject to its own particular design considerations depending on the use made of that system. For example, a storm drain is a drain which conducts storm surface, or wash water, or drainage after a heavy rain from a building to a storm or a combined sewer; whereas a sanitary sewer which is restricted to carrying sewage and to which storm and surface waters are not admitted.

Any sewage system generally includes a collection box into which the fluid to be carried away flows, and an appropriate drainage conduit which is fluidically connected to the collection box. The collection box is generally a cast-in-place concrete structure which includes side walls, a rear wall, and a front wall, with the fluid entering a collection box throat which is located adjacent to the front wall. The casting of such structures generally includes the use of falsework, which is a temporary support used until the main structure is strong enough to support itself. This falsework generally includes wood panels and he like formed by carpenters on the site according to the general shape and size of the structure being constructed. The semiliquid or viscous concrete is then poured into the falsework and allowed to harden, after which the top of the collection box is formed to close the collection box in the appropriate manner. Thus, the entire collection box is generally formed in at least two pours of concrete a first pour for the collection box walls and a second pour for the cover.

The top of the collection box also is formed using falsework which, in the past, has also been constructed in place by carpenters building a wood frame. This cover-forming falsework is then dismantled once the concrete of the cover has hardened. Again, the dismantling is done by hand.

Due to the manner of constructing the collection box, the general size and dimensions thereof may be subject to variations from a standard. However, since the cover falsework has been constructed by hand after the collection box sides have been formed, this dimension variation has not been a problem since it has been accounted for by the carpenter building the cover-forming falsework.

However, while permitting the cover-forming falsework to be matched and customized to the remainder of the collection box, this hand construction technique has many drawbacks. Such hand construction techniques are time consuming and wasteful of manpower during both the construction stage as well as during the dismantling stage.

However, in addition to wasting both time and money, such hand construction techniques may not result in a falsework that is the most ideal for the particular application. That is, for example, in the case of a storm sewer which is used to handle water in great quantities and often at high flow rates, the fluid entrance throat should be designed to most efficiently handle such flow rates and flow volumes. This design may include surfaces which are curved in particular manners and which may be located with respect to each other at very specifically defined spacings to cause the fluid to flow into and through the throat in the most efficient manner. Such curves may not be efficiently produceable using the wood falsework construction techniques of the prior art. Accordingly, such falsework may produce a cover that is generally acceptable for use in storm drains, but is not the most efficient for such an application.

Still another problem with such hand construction techniques may result from a lack of quality control. Thus, for example, if many storm drains are being constructed, there may be variations among such drains that are actually constructed which may result in different drains accommodating different flow rates and different volumetric flows. This variation could result in one area of a single system flooding while other areas of that same system do not flood. Such variation may be detrimental to an overall construction site.

Yet another problem which might occur with such hand-construction techniques may be related to a lack of research and development feedback to the builders and from the builders to anyone conducting research which might be pertinent. Thus, for example, if there is any problem with flow patterns, these problems may not be solved properly when there is a hand construction due to a lack of communication between the people actually building the collection boxes and anyone who might be involved in a research and development project which might have some application to such flow patterns in systems of this type. This lack of communication may result in the people involved in the building of such systems failing to receive information on any new shapes or techniques being developed in various studies.

Such quality and research control and rapid construction of articles may be associated with factory production of prefabricated products. Prefabricated products are often, in general, expeditiously set up and dismantled. However, mass production and prefabrication techniques have not been applied to the production of sewer systems because they have many problems as applied to such systems.

For example, since, as above mentioned, each of the several different types of sewer systems is subject to its own individual considerations that may vary due to the exigencies of construction in a particular site, much of any particular sewer system is generally formed in place at the construction site and may vary in dimensions due to the vagaries of the terrain. Accordingly, a prefabricated falsework may not properly fit the rest of a collection box that has been formed on site and has its dimensions dictated by the terrain at that site. It is quite difficult, and may be impractical, to adequately account for such wide variations in a practical manner in a manufacturing process. For this reason, drainage system collection box construction has not, heretofore, used the techniques of prefabrication and mass production, and thus has not fully realized the advantages of prefabrication and ass production techniques, and still uses the techniques of on-site hand construction which have been used in this art for many years and which are subject to all of the above-discussed drawbacks.

Accordingly, there is need for a means and a method for applying the techniques of prefabrication and mass production to the art of constructing falsework for forming cast-in-place and precast collection boxes and covers, especially storm drain collection boxes and covers.

OBJECTS OF THE INVENTION

Therefore the objects of the present invention are: to apply the techniques and advantages of prefabrication and mass production to the construction of sewer systems, in particular to storm drain systems; to provide a means and method for rapidly and easily setting up and dismantling falsework used in the construction of a storm drain collection box, particularly the cover of such storm drain collection box; to provide a falsework for use in the construction of storm drains that can be dismantled with minimal labor and time; to provide a falsework for forming a storm drain collection box cover that can be sized and shaped according to the most efficient way of accommodating the fluid flow associated with a particular storm drain yet can still be set up and dismantled in a cost and time effective manner; to provide a falsework for use in constructing the cover for a storm drain collection box that can permit variation of the size and dimensions of the cover, yet will still be easy and expeditious to set up and dismantle; to provide a means and method for efficiently producing an aesthetically pleasing cover for a storm drain collection box.

It is another object of the present invention to provide a falsework adaptable for precasting collection box covers for placement on precast storm drain collection boxes.

SUMMARY OF THE INVENTION

These, and other, objects are achieved by providing falsework that has certain parts thereof which are prefabricated, and could therefore be mass produced, and which includes elements that permit other parts of the falsework to be formed in-situ. The parts of the falsework that are prefabricated are the parts that will benefit most from mass production techniques and which are the parts that are least likely to need "customizing" for a particular application. On the other hand, the parts of the falsework that are not prefabricated, and hence will be formed by hand at the construction site, are those parts that are most likely to need changing based on the particular size and shape of the collection box as determined by the particular terrain and application of the drain system.

It has been found that the throat of the drain sewer collection box is a portion of such structure that is critical to the flow of fluid into the collection box, and hence can be important to the performance of the storm drain. The throat of a storm drain collection box should therefore be designed to most efficiently accommodate the large flow rates and volumes associated with a storm drain. Such design usually must consider flow mechanics and the like, and should not vary from collection box to collection box.

Furthermore, it has been found that the longitudinal and transverse dimensions of the collection box cover are subject to variation to account for variations in the walls and dimensions of the in-place collection box, and that variations from standard or ideal of these dimensions do not affect the performance of the storm drain as greatly as do throat dimension variations from standard or ideal. Therefore, the longitudinal and transverse dimensions of the cover should be amenable to being "customized" in-situ. This adaptability can be achieved by permitting the portion of the falsework associated with the ends and sides of the cover to be formed by hand since the spacing between the ends of the cover determine the longitudinal dimension of the cover, and the spacing between the sides of the cover determine the transverse dimension of the cover.

Accordingly, the objects of the present invention are achieved by prefabricating that portion of a storm drain collection box cover falsework associated with the collection box throat, while having the remaining portions of the falsework hand constructed in-situ. In this manner, that portion of the storm drain collection box most amenable to mass production and most likely to benefit from such production technique is the very portion that is prefabricated, while those portions of the storm drain collection box that are most efficiently produced in place at the site are those portions that are hand constructed in-situ. Thus, the advantages of mass production are achieved without suffering its drawbacks or without sacrificing the advantages of hand construction techniques, and vice versa.

Specifically, the falsework embodying the present invention includes a monolithic collection box throat-forming section which includes means for supporting stringers and panels that are respectively used to form a support lattice and side and end forms for the cover. The support lattice can be adjusted according to the spacing between the in-situ collection box walls, while the end and side panel forms can be adjusted according to the relative placement, dimensions and shapes of the in-situ collection box walls. The throat-forming section is prefabricated and can be used again and again, while the support lattice stringers and the side and end form panels can be built and dismantled for each application.

Alternatively, the storm drain collection box cover can be precast using the falsework of the present invention for in-situ placement on either a poured-in-place or a precast collection box.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
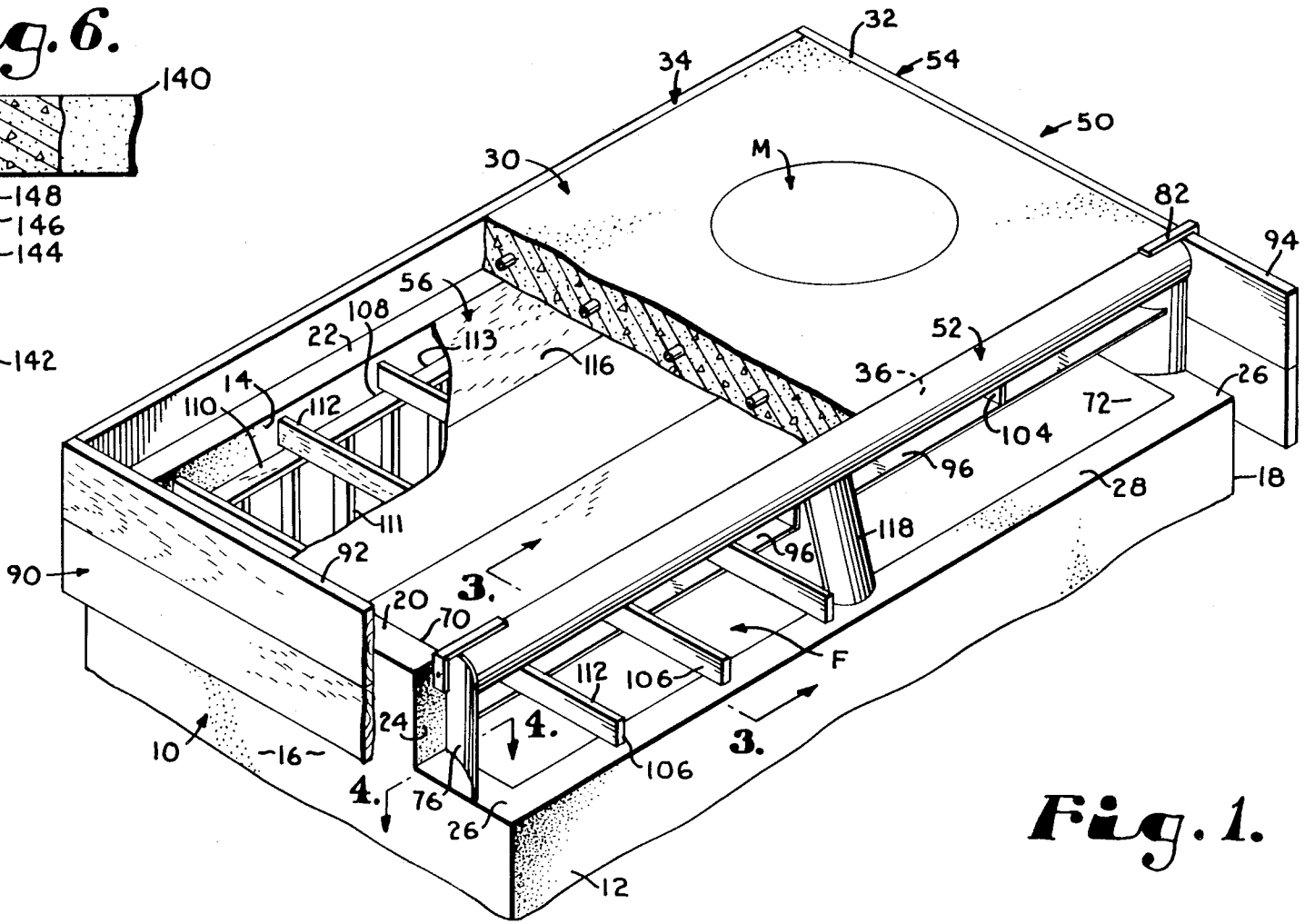
FIG. 1 is a front perspective view of the falsework embodying the present invention in use in conjunction with a storm drain collection box.

Shown in FIG. 1 is a top portion of an in-place collection box 10 associated with a storm drain (the conduits of which and the bottom of which are not shown), and which includes a front wall 12, a rear wall 14 and end walls 16 and 18. As shown, the rear wall 14 and the end walls 16 and 18 include top edges, such as top edge 20 on end wall 16 and top edge 22 on rear wall 14, that are coplanar with each other, and the ends walls include end edges, such as end edge 24 on end wall 16, that are coplanar with each other and which are located a distance spaced from the front wall 12 to define notched portions 26 on the end walls. The front wall 12 includes a top edge 28 that is coplanar with notched portions 26 of the end walls. The top edge 28 of the front wall defines an entrance apron over which water flows into the collection box as during operation of the storm drain. The water flow is indicated in FIG. 1 by arrows F.

The storm drain collection box 10 includes a monolithic cover 30 that, in use, rests on the end and rear wall top edges 20 and 22. The cover 30 is reinforced concrete and includes end edges, such as end edge 32, side edges 34 and a front edge 36 (which is hidden in FIG. 1, but which is clearly shown in FIGS. 3 and 5). The cover 30 has a longitudinal dimension measured between the end edges 32 that corresponds to the longitudinal dimension of the collection box as measured between the end walls 16 and 18 and a transverse dimension measured between the side edge 34 and front edge 36 which corresponds to the transverse dimension of the collection box as measured between the rear wall 14 and the end wall end edges 24. Accordingly, the size of the cover 30, as defined by its longitudinal and transverse dimensions, is dependent upon the spacing between the collection box end walls 16 and the longitudinal extent of the end wall top edges 20, respectively. Such spacings may vary according to the terrain into which the collection box is set and according to the vagaries of the construction process. Therefore, the aforementioned dimensions of the cover 30 should be variable according to the needs of the particular collection box 10. The cover 30 can also include a manhole opening M.

Figure 3:
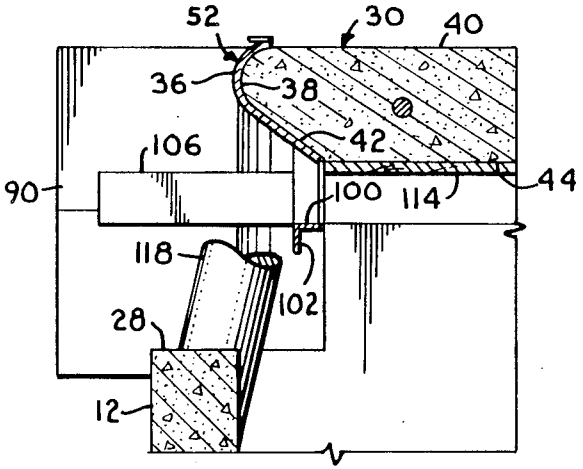
FIG. 3 is an elevation view taken along lines 3—3 of FIG. 1.

The front edge 36 of the cover 30 is best shown in FIG. 3, and attention is now directed to FIG. 3. The front edge 36 is cambered to be convex with respect to the flow direction of the fluid entering the collection box and includes an arcuate portion 38 located adjacent to top surface 40 of the cover 30 and a planar portion 42 connecting the arcuate portion 38 to bottom surface 44 of the cover 30.

Figure 4:
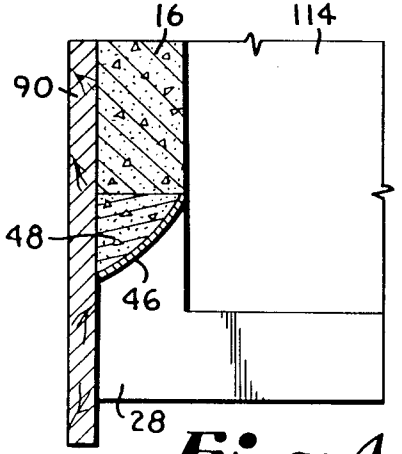
FIG. 4 is a top plan view taken along lines 4—4 of FIG. 1.

To most efficiently accommodate the water flowing into the collection box, the throat also includes arcuate sides, such as side 46 shown in FIG. 4 to which attention is now directed in combination with FIG. 1. As is best shown in FIG. 4, each of the sides of the throat is monolithic with the rest of the cover 30 and includes a section, such as section 48 shown in FIG. 4, which is convexly curved to be sideways converging in the direction of flow into the collection box. Each section 48 abuts the front end edge 24 of a corresponding collection box end wall.

Thus, a converging nozzle-like throat is defined by the cover front edge 36, the collection box front wall top edge 28 and the cambered sections 48. The curvature of the convex portion 38 and the dimensions of the planar portion 42 as well as the curvature and the dimensions of the arcuate sections 48 are all selected to cooperate with the planar top edge 28 of the front wall 12 to define a throat for the collection box 10 that most efficiently accommodates the water flowing into the collection box. The arcuate nature of the leading edge 36 and the sections 48 also present an aesthetically pleasing appearance to the in-place collection box, and the monolithic nature thereof tends to increase the overall force and damage resisting properties of the cover 30.

A falsework 50 is shown in FIG. 1 and is used in the construction of the cover 30. This falsework 50 includes a prefabricated monolithic throat-forming portion 52, a cover side and rear edge-forming panel portion 54 and a bottom-supporting lattice portion 56. The falsework portions cooperate with each other and with the in-place elements of the collection box to permit the cover to be formed by pouring concrete which is in a semiliquid or viscous state into the falsework after the collection box walls are set up. Once the cover 30 hardens to become solid, the falsework 50 is removed. The prefabricated throat-forming portion is reusable, and the panel portion 54 as well as the bottom-supporting lattice portion 56 are hand-fabricated and hand-dismantled. The prefabricated throat-forming portion permits the critical throat portion of the collection box to be formed using a form that has been manufactured under both quality- and research-controlled conditions; whereas, the panel and bottom support lattice portions are amenable to being formed to have dimensions, shapes and sizes as required by the particular collection box being formed. Accordingly, the cover of the collection box can be formed using the advantages of both mass production and hand manufacture. More specifically, since the cover controls the shape and efficiency of the throat, that part of the collection box, the throat, that is best manufactured under the quality- and research-controlled conditions is, indeed, manufactured under those conditions; whereas, that portion of the collection box that is best formed according to the exact requirements of the particular collection box, is, indeed, manufactured under such conditions.

Figure 2:
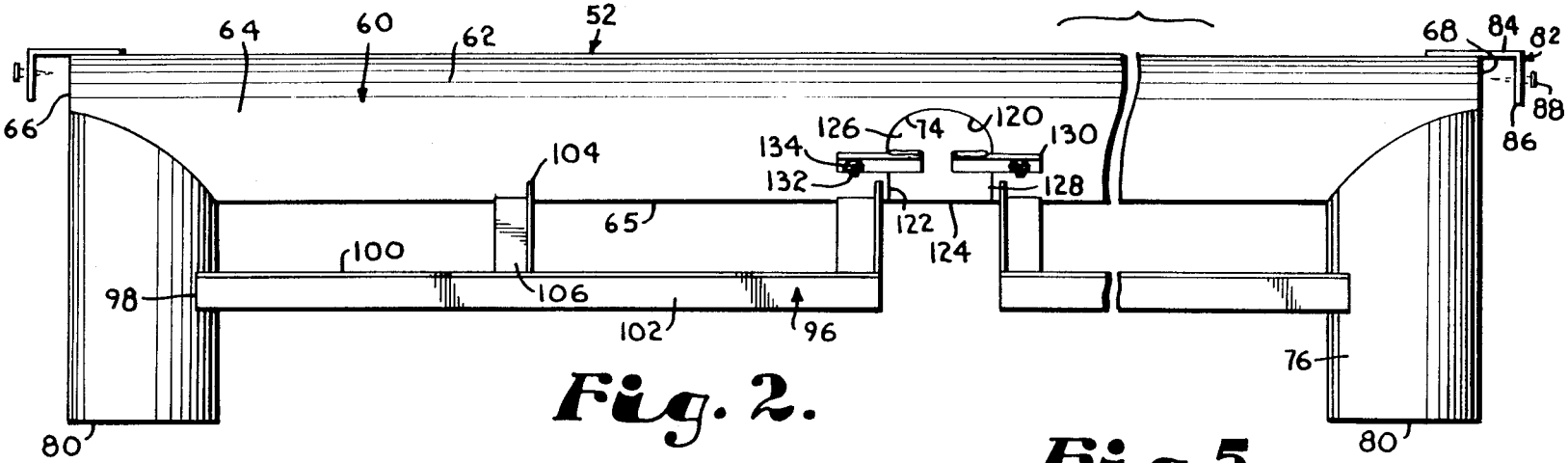
FIG. 2 is a front elevation view of a collection box throat forming portion of the falsework embodying the present invention.

The monolithic throat-forming portion 52 is best shown in FIG. 2, and attention is now directed to such FIGS. The portion 52 includes an elongate arcuate body section 60 that has a curved section 62 which forms a curved portion 38 of the cover front edge, and a planar section 64 that forms a planar portion 42 of the cover front edge. Therefore, those sections of the body section 60 are sized and shaped accordingly. The planar section 64 terminates at a back edge 65. The body section 60 has a longitudinal extent from end edge 66 to end edge 68 thereof that approximates the longitudinal extent of the collection box between the inner surface 70 of end wall 16 to the inner surface 72 of end wall 18. A cut-out 74 is defined in the body section 60 for a purpose that will be discussed below.

An arcuate edge-forming section 76 is located at each end of the body section 60. These edge-forming sections 76 are shaped and sized to correspond to the shape and size of the arcuate sections 48 and are located accordingly. Each of the sections 76 has a bottom end edge 80 which rests on the notch forming portion 26 of the associated collection box end wall to support the throat-forming portion 52 in place on the collection box walls to form the cover 30.

The throat-forming portion 52 also includes a hanger clip 82 on each end 66 and 68 thereof. Each of the clips 82 is L-shaped and, includes a long leg 84 mounted on top of the body section 60 to be horizontally disposed, and a short leg 86 which is vertically disposed. A jam fastener, such as screw 88, is movably mounted on each short leg 86 to be movable toward and away from the associated body section end edge for a purpose to be discussed below.

The hanger clips 82 releasably attach the falsework panel portions 54 to the throat-forming portion 52 as is best shown in FIG. 1 to which attention is now directed. The panel portions 54 include a plurality of panels, such as panel 90, which can be a two-by-twelve board, or like element. As shown in FIG. 1, the panels 90 have inside surfaces, such as surface 92, in abutting contact with the outside surface of the collection box walls 14, 16 and 18, and an outside surface, such a surface 94, which is adapted to be in abutting contact with the screws 88 of the hangers 82. The panels are held onto the collection box walls by nails, or other such fastening means, and the clips 82 help to hold the panels in position against the collection box end walls 16 and 18 so that the top edges thereof are located above the plane of the collection box wall top edges. The clips 82 also hold the panels 90 in position to define a well with the edge-forming sections 76 of the throat-forming portion 52. The well defined by the panels and the section 76 is used as a form to contain concrete in the construction of the convex sections 48. The clips 82 hold the panels and the sections 76 in a proper relative positioning during hardening of the sections 48. The panel portion 54 is thus manufactured by hand in-situ.

As shown in FIG. 2, the throat-forming portion 52 also includes an elongate support bracket 96 which has ends 98 thereof attached to the edge-forming sections of the portion 52. The bracket 96 is L-shaped to include a top leg 100 which is horizontally disposed and a side leg 102 which is vertically disposed. A plurality of hanger brackets 104 attach the support bracket 96 to the body section 60 at spaced-apart positions on the bracket 96.

Referring again to FIG. 1, it is seen that the falsework lattice portion 56 includes a plurality of stringers, such as stringer 106, which can include two-by-fours, or the like, and which are supported in the manner of a simple beam by the support bracket 96 adjacent to one end of each stringer 106 and by a crib structure 108 spaced slightly inwardly from the inner surface of the collection box rear wall 14 to have the top edge 110 thereof located to be coplanar with the support bracket top leg 100. The crib structure 108 may be formed of studs 111 extending to a collection box bottom 136 and supporting a crib structure top plate 113 which forms the crib structure top edge 110. In this manner, the stringers 106 extend across the transverse dimension of the collection box to have the top edges 112 thereof positioned in a coplanar arrangement.

The supporting lattice 56 further includes a platform 114 which includes a plurality of planar sections, such as platform section 116, supported on the top edges 112 of the stringers 106 to span the collection box between the end walls and between the front and the rear walls thereof. With the platform and the collection box wall top edges, the falsework has a continuous bottom upon which semiliquid or viscous concrete can rest until it is hard and solid. The supporting lattice 56 includes elements that are hand formed in-situ and can be altered according to the needs of the particular application.

The panels 90, the lattice support portion 56, the throat-forming portion 52 and the edge-forming sections 76 all cooperate to define the falsework 50 to support the cover 30 while it is hardening and until such cover 30 is strong enough to support itself in position on the collection box 10.

It is noted that since the throat-forming portion 52 is prefabricated, it may not be amenable to having its longitudinal dimension altered to account for wide variations in the length of the collection box. Even though the thickness of the walls 16 and 18 will permit some variation in such length dimension without rendering the throat-forming portion useless, great variations in such dimension will require the use of several different throat-forming portions. Alternatively, the body section 60 of the throat-forming portion 52 could be manufactured in sections that fit together after the longitudinal dimension of the portion 52 has been adjusted to correspond to the longitudinal dimension of the collection box on which the cover is to be located.

Figure 5:
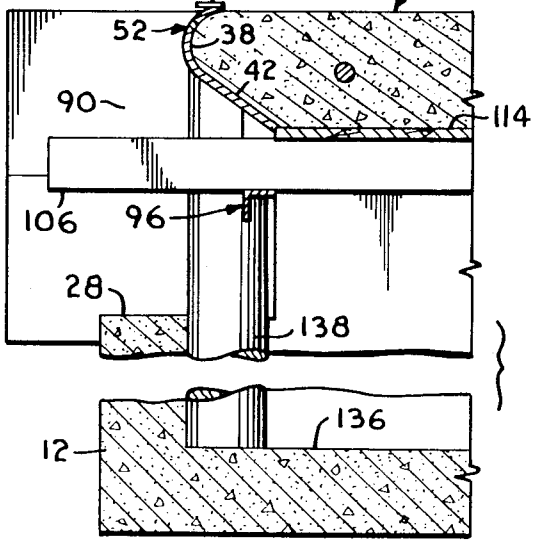
FIG. 5 is a top plan view similar to FIG. 4 showing an alternative form of a portion of the falsework embodying the present invention.

Certain collection boxes may be short enough so that the cover will need only the support afforded by the walls 14, 16 and 18. However certain collection boxes may be so long as to require additional support for the cover between the walls 16 and 18. Such additional support can be provided by a support post 118 shown in FIG. 1. This support post 118 extends from the planar portion 42 of the cover front edge 36 to the top edge 28 of the collection box front wall 12. The cut-out 74 in the throat-forming body portion 52 is adapted to admit poured concrete into a support post form (not shown) extending between the planar section 64 of the elongated throat-forming portion 52 and the collection box front wall 12. As shown in FIG. 2, the cut-out 74 includes a semi-circular front portion 120 and a generally rectangular back portion 122. A cut-out plate 124 includes a semi-circular front portion 126 and rectangular back portion 128 and fills the cut-out 74 when it is desired to use the falsework throat-forming portion 52 without forming the support post 118. The cut-out plate 124 is removably mounted in the cut-out 74 by bars 130 welded to the cut-out plate 124 and projecting under the planar section 64 of the throat-forming portion 52, whereat they receive respective threaded studs 132 affixed to and projecting from the planar section 64. Each stud 132 threadably receives a respective nut 134. As shown in FIG. 2, the cut-out back portion 122 is open at the back edge 65 of the planar section 64 of the falsework throat-forming portion 52. The support post 118 is generally required if the cover 30 has a length in excess of about eight feet. The support post can also be supported on the bottom 136 of the collection box as shown in FIG. 5 for a support post 138, in which case the support post is vertically disposed as opposed to being inclined as shown in FIG. 3.

Based on the above disclosure, the process of forming a collection box and of using the falsework 50 to form the monolithic cover 30 should be evident to one skilled in the art. However, in the interest of presenting a full and complete disclosure, such method will now be briefly reviewed.

The collection box walls 12, 14 and 16 are cast in place using the methods usual to such procedure. After these walls are set, the collection box cover 30 can be formed. The falsework panel portion 54 is constructed by attaching the panels 90 to the walls 12, 14 and 16, and the crib structure 108 is attached to the inner surface of the rear wall 14. The falsework throat-forming portion 52 is placed on the wall top edges in the notched portions 26 to be supported by the edge-forming sections 76 thereof. The clips 82 are then used to secure the panels 90 to the throat-forming portion 52. The falsework supporting lattice portion 56 is then erected by placing the stringers 106 in position on the support bracket 96 and on the crib structure 108, and then locating the platform 114 in position on the stringer top edges 112 The falsework is now ready to accept fluid concrete in the pour associated with the formation of the cover 30.

Concrete is then poured into the falsework and such concrete will flow into the wells formed between the sections 76 and the panels 90 to define the sections 48 as indicated in FIG. 4. If a support post 118 or 138 is to be used, the cut-out plate 124 is removed so that the fluid concrete will also flow into the support post form (not shown) via the cut-out 74 in the throat-forming body section 60. If the cover 30 is to include reinforcing rods, such will be placed in position at the proper times as will occur to those skilled in the art. The manhole M can also be formed in a manner as will occur to those skilled in the art.

After the concrete has hardened sufficiently to be self-supporting, the falsework can be removed. This dismantling is accomplished by releasing the clips 82 from engagement with the panels 90 and removing the panels 90 from the collection box walls. Since the crib structure 108 is spaced slightly inwardly from the collection box inner wall 14, a rod (not shown) with a hook end can be inserted through the collection box throat and hooked behind the crib structure 108 for pulling it out from under the stringers 106. The stringers 106 and the platform sections 116 will thus be unsupported at the back of the collection box 10, and the crib structure 108, the stringers 112 and the platform sections 116 can be removed from the collection box 10 through its throat. The throat-forming portion 52 is removed from the position shown in FIG. 1. If a support post 118 or 138 was formed, the support post form will have been removed prior to removal of the throat-forming section. The configuration of the cut-out 74 with its rectangular back portion 122 open at the back edge 65 permits the falsework throat-forming portion 52 to slide forwardly clear of a support post 118 or 138 when the throat-forming portion 52 is removed.

Figure 6:
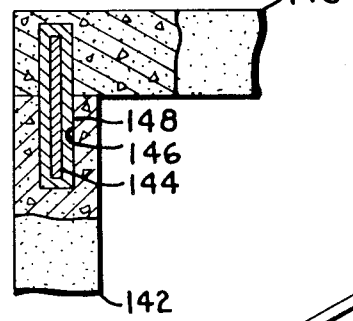
FIG. 6 is an enlarged, fragmentary, vertical cross-sectional view of a precast collection box cover formed with the falsework embodying the present invention and mounted on a precast collection box.

As an alternative to the forming method described above, the falsework 50 of the present invention can be used to produce a precast collection box cover 140 (FIG. 6) for placement on collection boxes that are either poured-in-place or precast. When a collection box 142 is precast, a base, including the collection box bottom 136, is often poured-in-place in-situ so that various site conditions such as grade, elevation, soil bearing capacity, etc. can be accommodated. The collection box 142 is then precast off-site (e.g. at a concrete precast plant) for placement on the poured in place collection box base. The cover 140 may also be precast off-site for in-situ mounting on the precast collection box 142. The cover 140 can be secured by reinforcing bar dowels 144 which extend into the collection box rear and end walls and which also extend into the cover 140. The reinforcing bar dowels 144 can be secured in place in receivers 146 in the collection box 142 and in the cover 140 by grout 148.

It is to be understood that while certain forms of the present invention have been illustrated and described herein, it is not to be limited to the specific forms or arrangement of parts described and shown.

What is claimed and desired to be secured by Letters Patent is as follows:

1. A falsework for use during the forming of a storm drain, said drain including a collection box having a front wall, a rear wall, and end walls forming a chamber, said falsework for forming a collection box cover, said cover having cover top surface, a cover bottom surface facing the collection box chamber, cover side edges supported by said end walls, a cover rear edge disposed adjacent to and supported by the collection box rear wall, and a cover front edge spaced above the collection box front wall thereby forming a throat opening into said collection box chamber, said collection box cover forming falsework comprising:

(a) a monolithic, prefabricated throat-forming section which is adapted to be located adjacent to the collection box front wall and which includes:

(1) means for forming the front edge of the collection box cover; and (2) means for forming side sections of said throat each of which is positioned on said cover front edge forming means for location adjacent to an intersection between the collection box front and end walls and cover side edges;

(b) means for forming the side edge and rear edges of the collection box cover;

(c) attaching means mounted on said throat forming section for releasably connecting said side and rear edge forming means to said throat-forming section;

(d) means for forming the bottom surface of the cover over said collection box chamber; and (e) support bracket on said throat forming means for releasably positioning said bottom cover surface forming means on said throat forming means.

2. The cover forming falsework defined in claim 1 wherein:

(a) said means for forming said bottom cover surface further includes a crib structure affixed to an inner surface of the collection box rear wall and a plurality of stringers spanning across the collection box chamber from the collection box front wall to the collection box rear wall and being supported on said crib structure and on said support bracket, and means for affixing said crib structure to said collection box rear wall.

3. The cover forming falsework defined in claim 2 wherein:

(a) said means for forming said bottom cover surface further includes a platform means resting on said stringers.

4. The cover-forming falsework defined in claim 3 wherein:

(a) said platform means includes a plurality of separable sections.

5. The cover forming falsework defined in claim 3 wherein:

(a) said collection box side and rear edges forming means includes a plurality of panels adapted to be affixed to the collection box walls, and means for affixing said panels to the collection box walls.

6. The cover forming falsework defined in claim 1 further including a flow channel means connected to said side section forming means for permitting fluid cement to flow to said side section forming means.

7. The cover forming falsework defined in claim 1 wherein:

(a) said cover front edge forming means includes an arcuate portion and a planar portion.

8. The cover forming falsework defined in claim 1 wherein:

(a) said means for forming said cover bottom surface further includes a plurality of hanger brackets connecting said support bracket to said cover front edge forming portion.

9. The cover-forming falsework defined in claim 1 further including a support post forming means for forming a support post intermediate the throat side sections, said post forming means extending from the cover front edge forming means to at least the collection box front wall 10. The cover-forming falsework defined in claim 9 wherein:

(a) said support post forming means includes a multi-part form and means for releasably connecting the parts of the form together, and means for releasably attaching said multi-part form to said cover front edge forming means.

11. The cover-forming falsework defined in claim 10 wherein:

(a) said multi-part form is adapted to extend to the collection box front wall.

12. The cover-forming falsework defined in claim 10 wherein:

(a) the collection box further includes a bottom and said multi-part form is adapted to extend to the collection box bottom.

13. The cover-forming falsework defined in claim 11 wherein: (a) said multi-part form is positioned to form a support post that is inclined upwardly from the collection box front wall towards the collection box rear wall.

14. The cover-forming falsework defined in claim 12 wherein:

(a) said multi-part form is positioned to form a support post that is vertically disposed.

15. The cover-forming falsework defined in claim 1 wherein:

(a) said attaching means includes fasteners.

16. The cover-forming falsework defined in claim 1 wherein:

(a) said side section forming means are adapted to form arcuate side section in said throat.

17. The cover-forming falsework defined in claim 16 wherein:

(a) said side section forming means are adapted to form convex side sections in said throat.

* * * * *